US012043961B2

(12) United States Patent
McDonald

(10) Patent No.: US 12,043,961 B2
(45) Date of Patent: Jul. 23, 2024

(54) SYSTEM FOR MANAGING SOLIDS IN PAPERMAKING WHITEWATER

(71) Applicant: Joseph P. McDonald, Appleton, WI (US)

(72) Inventor: Joseph P. McDonald, Appleton, WI (US)

( * ) Notice: Subject to any disclaimer, the term of this patent is extended or adjusted under 35 U.S.C. 154(b) by 153 days.

(21) Appl. No.: 17/595,143

(22) PCT Filed: May 7, 2020

(86) PCT No.: PCT/US2020/031770
§ 371 (c)(1),
(2) Date: Nov. 10, 2021

(87) PCT Pub. No.: WO2020/231721
PCT Pub. Date: Nov. 19, 2020

(65) Prior Publication Data

US 2022/0195668 A1 Jun. 23, 2022

Related U.S. Application Data

(60) Provisional application No. 62/848,792, filed on May 16, 2019.

(51) Int. Cl.
*D21F 1/66* (2006.01)
*D21C 11/00* (2006.01)
(Continued)

(52) U.S. Cl.
CPC ..... *D21F 1/66* (2013.01); *D21C 11/0042* (2013.01); *D21F 1/68* (2013.01); *D21F 1/72* (2013.01); *D21H 17/01* (2013.01)

(58) Field of Classification Search
CPC ..... D21F 1/66; D21F 1/68; D21F 1/72
(Continued)

(56) References Cited

U.S. PATENT DOCUMENTS 2,368,635 A * 2/1945 Lippincott ..... D21H 17/68 162/190
3,833,468 A 9/1974 Boniface
(Continued)

FOREIGN PATENT DOCUMENTS

GB 1183976 A 3/1970

OTHER PUBLICATIONS

McDonald et al., An Innovation Journey in Tissue Making: A Fractionation System for Controlling Ash and Fines in Whitewater, 2010, PaperCon, Paper and presentation [downloaded online from tappi.org] (Year: 2010).*

(Continued)

*Primary Examiner* — Anthony Calandra
(74) *Attorney, Agent, or Firm* — Bell & Manning, LLC

(57) ABSTRACT

Methods and systems for reducing the loss of usable fibers from whitewater while simultaneously increasing paper making machine performance and paper quality are provided. The methods and systems utilize a fractionating saveall to separate whitewater into a dilute wastewater fraction that contains unwanted fine particles and a thicker consistency reusable fraction containing paper-forming fibers. The reusable fraction is recirculated back into the whitewater stream, while the wastewater is routed away from the whitewater stream.

4 Claims, 1 Drawing Sheet

(51) Int. Cl.
*D21F 1/68* (2006.01)
*D21F 1/72* (2006.01)
*D21H 17/01* (2006.01)

(58) Field of Classification Search
USPC ..... 162/190, 264
See application file for complete search history.

(56) References Cited

U.S. PATENT DOCUMENTS

| | | | | |
|---|---|---|---|---|
| 5,944,957 | A * | 8/1999 | Fagerlund | D21G 9/0027 162/DIG. 11 |
| 6,622,868 | B1 | 9/2003 | McDonald | |
| 7,055,697 | B2 | 6/2006 | McDonald | |
| 2003/0000669 | A1 * | 1/2003 | Strand | D21G 9/0018 162/49 |

OTHER PUBLICATIONS

Smook, Handbook for Pulp and Paper Technologists, 1992, Angus Wilde Publications, 2nd edition, chapter 16. (Year: 1992).*

The International Search Report and the Written Opinion issued on Jul. 31, 2020 for international patent application No. PCT/US20/31770; pp. 1-8.

"The Fractionating Saveall TM—A Green Technology for Controlling a Whitewater System," by Innovationedge, (2008) Retrieve from the Internet Jul. 14, 2020. URL,http://www.innovationfatigue.com/wp-content/uploads/2009/07/Fractionating_Saveall_Summary.pdf. Entire document, especially p. 2.

Guay et al., "Evaluation of a Fractionating Saveall," 2007 TAPPI Papermakers and PIMA International Leadership Conference; pp. 1-6.

"Paper Making; Overview and Introduction," https://www.fibrelab.ubc.ca/filed/2013/01/Topic-11-Papermaking-introduction-text pdf, Available online prior to May 16, 2019, pp. 1-20.

Pratima Bajpai, "Chapter 2; Overview of Pulp and Papermaking Processes," *Environmentally Friendly Production of Pulp and Paper* Mar. 2011; pp. 1-38.

Linda Robertson, "Microbes in the Papermachine Environment," Presentation prepared for TAPPI PaperCon Conference 2011; pp. 1-91.

Mini-Encyclopedia of Papermaking Wet-End Chemistry, Part Two: Definitions and Concepts—"Wet End," The page is maintained by Martin Hubbe, Associate Professor of Wood and Paper Science, NC State University, m_hubbe@ncsu.edu., p. 1 of 1.

Martin A. Hubbe, "Water and Papermaking 3. Measures to Clean up Process Water," *Paper Technology*, Apr. 2007, Water and Paper Making 3; pp. 23-30.

* cited by examiner

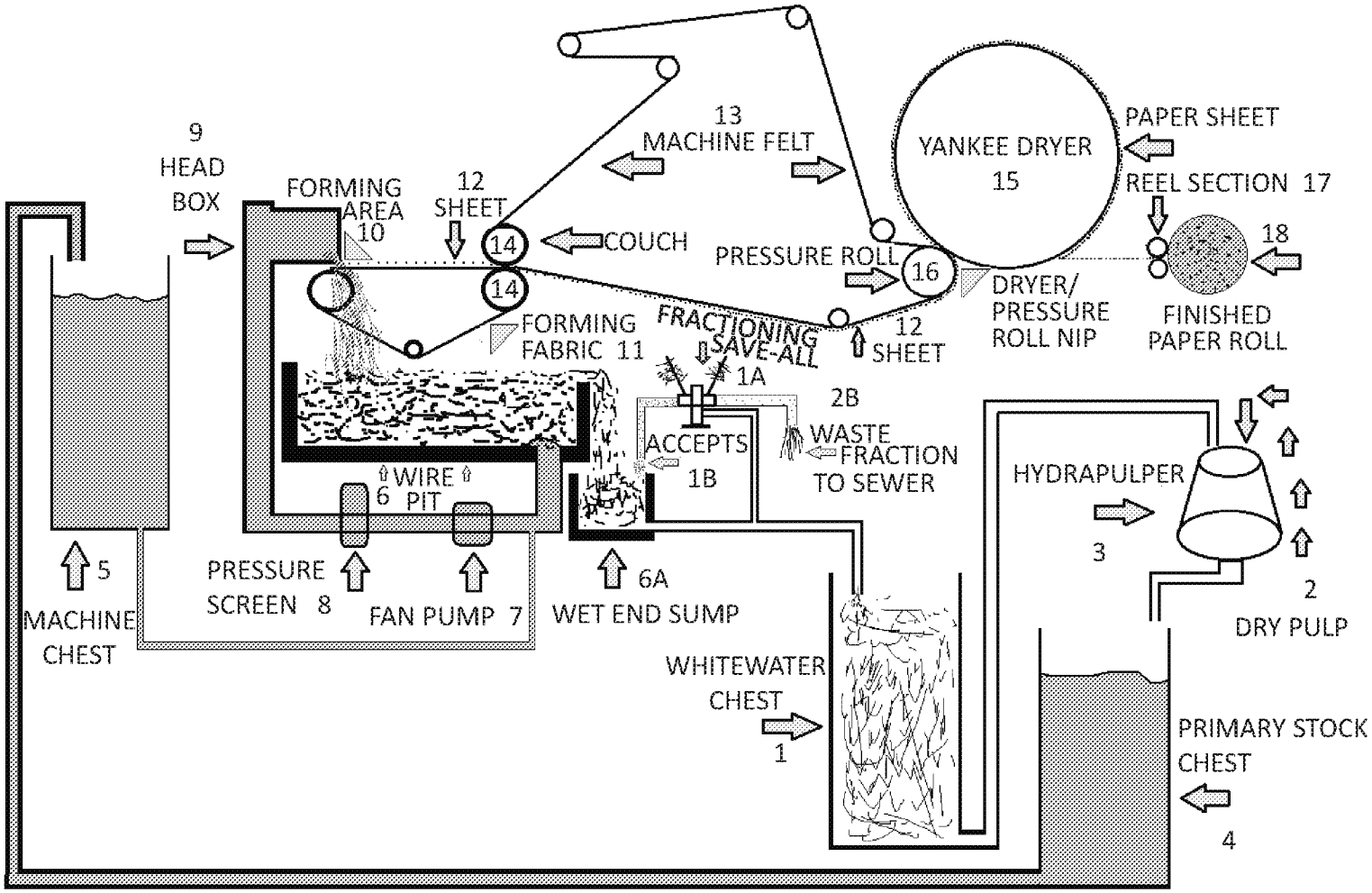
PAPER SHEET
REEL SECTION 17
18
FINISHED PAPER ROLL
YANKEE DRYER 15
DRYER/ PRESSURE ROLL NIP
16
12 SHEET
PRESSURE ROLL
13 MACHINE FELT
COUCH
14
14
12 SHEET
FORMING AREA 10
9 HEAD BOX
FORMING FABRIC 11
FRACTIONING SAVE-ALL
1A
ACCEPTS 1B
2B
WASTE FRACTION TO SEWER
WIRE PIT 6
6A
WET END SUMP
FAN PUMP 7
PRESSURE SCREEN 8
5 MACHINE CHEST
HYDRAPULPER
3
2 DRY PULP
PRIMARY STOCK CHEST 4
WHITEWATER CHEST 1

SYSTEM FOR MANAGING SOLIDS IN PAPERMAKING WHITEWATER

CROSS-REFERENCE TO RELATED APPLICATIONS

This application is a National Stage of International Application No. PCT/US20/31770, filed May 7, 2020, which claims the benefit of U.S. Patent Application No. 62/848,792, filed May 16, 2019, the contents of which are herein incorporated by reference.

BACKGROUND

This invention relates to a process for making products such as paper from pulp or other fiber-containing material, and more particularly to a process for recovering and recirculating usable fibers contained in water produced in such a process.

Many papermakers fail to manage whitewater because they lack the necessary control to do so. Papermaking is a drainage-oriented process polluted with drainage inhibiting material. Drainage inhibiting materials are generated when cellulose is manipulated. Controlling ash/fines in the process is critically important because when their concentrations reach high enough levels these materials can have many unfavorable consequences. These include, but are not limited to, the degradation of: chemical efficiency, brightness, felt life, fabric life, moisture profile, dryer coating, crepe uniformity, sheet appearance, formation, the ability to consume broke, the ability to minimize furnish costs, freeness, drainage, machine speeds, production levels, microbiological growth, sewer loss, and the like. By purging particulate matter from the papermaking system, these consequences can be dealt with simultaneously rather than one-at-a time. This is a far more efficient and cost-effective method of trouble shooting than the way these issues are often handled.

The manufacture of products such as paper uses fibrous material like wood pulp, which is processed in a known manner to produce the desired end product. In a paper making process, an aqueous pulp slurry (stock) is applied to a screen or paper making fabric from a headbox, and water is drained out of the pulp in a known manner to form the paper, which is dried and formed into a roll. The water that is drained out of the pulp is commonly known as whitewater and typically includes small particles of fines and ash material, which can pass through the fabric along with the water. In addition, the whitewater inevitably includes a quantity of usable fibers.

The paper making industry is plagued by two significant problems. First, paper making produces large quantities of whitewater, much of which is routinely discarded, along with the useful paper-making fibers contained therein. Second, it is difficult to control the amount of fines in the process stream. Fines, also known as particulate matter, can degrade paper quality, inhibit drainage, and produce many operational issues for the papermaker. In short, papermaking is a drainage-oriented process polluted with drainage inhibiting material. Before a sheet of paper can be produced, cellulose must be manipulated. These manipulating processes break down some of the fiber into fines. There is a limit to the amount of fines tolerable in the process stream, and controlling their concentration is critical to maximizing machine performance.

Paper making is a water-intensive process; in addition to the water that comes in with stock from the headbox, water is continually introduced through cleaning showers, lubricating showers, knock-off showers, breast roll showers, couch roll showers, internal showers, leaky packing glands, and flush lines. Various additives and chemicals also enter the wet-end of the process as aqueous solutions. All of this added water becomes part of the whitewater system because these streams merge as the sheet is formed. Since the wet-end whitewater contains fiber and particulate matter alike, it is not well suited for use in most of the original applications (except for making stock) and must be clarified before reuse. In other words, the paper making process generates more whitewater than it can consume in the preparation of stock. Also, the practice of recycling whitewater to make stock recycles everything in it: usable fiber and fines alike. Unfortunately, when the solids are recycled this way, fines concentrations can exceed tolerance levels. This jeopardizes not only machine performance but product quality as well.

The practice of using disk saveall or dissolved air floatation (DAF) clarification to recover whitewater solids is well known throughout the industry. These technologies are normally used to recover fiber from the excess whitewater produced. However, since they recover fines as well as usable fiber, their use contributes to particulate matter pollution in the papermaking process. Since there is a limit to the amount of fines which can be tolerated, there is subsequently a limit to the amount of fiber which can be recovered this way. Importantly, fiber recovered from whitewater is normally returned into the stock system in conventional papermaking processes.

Other principal features and advantages of the invention will become apparent to those skilled in the art upon review of the following drawings, the detailed description, and the appended claims.

SUMMARY

Methods for recovering usable pulp fibers in a paper making system are provided.

One example of a method for recovering usable pulp fibers in a paper making system includes the steps of: passing whitewater from a wet-end sump pit at the wet-end of a paper making system into a Fractionating Saveall, whereby the Fractionating Saveall separates the whitewater into a wastewater fraction in which particulate matter (fines) is concentrated and a reusable fraction in which usable pulp fibers are concentrated; discharging the wastewater fraction from the paper making system; and circulating the useable fraction directly back into whitewater in the wet-end, or other points of the whitewater system, of the paper making system.

BRIEF DESCRIPTION OF THE DRAWING

Illustrative embodiment of the invention will hereafter be described with reference to the accompanying drawing, wherein like numerals denote like elements.

FIG. 1 is a schematic representation of an embodiment of a paper making system incorporating a Fractionating Saveall as a mechanical drainage aid and usable fiber recovery device back into the wet-end whitewater sump or elsewhere in the whitewater system. Positioning the Fractionating Saveall so as to recover fiber into the whitewater system has several important benefits. Although FIG. 1 shows the recovery of usable fiber with a Fractionating Saveall into the wet-end sump, other vessels containing whitewater can be used as recovery points (for example, the whitewater chest, wire pit, or silo). When fiber is recovered from whitewater, it is conventionally returned into either a stock chest already containing stock, a chest designated specifically for the recovered fiber stream, or a hydrapulper. It is not returned into the whitewater system. This is because whitewater is difficult to contain given the volumes involved. It makes little sense to recover usable fiber into a whitewater system at one point only to have it overflow to the sewer somewhere else.

DETAILED DESCRIPTION

For the purposes of this disclosure, the following terms have the following definitions. The wet-end of the machine refers to the end of the machine where the sheet is formed. They include the wire pit, fan pump, pressure screen, head box, forming area, and forming fabric. The dry-end generally refers to the pressure roll, dryer, and reel section where the paper is dried and wound up into a roll.

Whitewater refers to water that has been drained out of the sheet during formation. It also includes water coming from showers, chemical solutions, and the like which are needed to maintain the operation of wet-end components. The water from these systems then mixes continually with the contents of the wire pit. Usable fiber refers to pulp fibers that can be easily incorporated into a paper product (e.g. fibers longer than 0.2 mm in length). It does not include the fines.

Stock refers to an aqueous slurry of pulp fibers intended to supply the raw material for a papermaking process. In contrast, fines refer to small particles of particulate matter (usually fiber fragments less than 0.2 mm in length) which are found in both the stock and whitewater systems. These substances naturally develop when pulp fibers are manipulated. In high concentrations, they are undesirable because they degrade the quality of the paper produced and can attack the systems, adversely affecting chemical efficiency, brightness, clothing life, drainage, machine speeds, production levels, etc.

Stock preparation (or stock prep) refers to the series of operations in which pulp is mechanically and/or chemically processed to tailor the pulp stock properties for a given paper product. Stock preparation typically includes beating (using, for example, a hydrapulper) to swell and soften the pulp fibers as they are mixed with water to produce the stock.

It should be noted that the systems described herein differentiate a whitewater system as compared to a stock system. For the purpose of distinguishing between the two, it should be noted that stock systems are intended to supply raw material (stock) to the paper making machine. Whitewater, on the other hand, is a lower consistency stream of water, recovered after the sheet is formed and later used to mix with more fiber in the process of generating more stock.

The term "Fractionating Saveall" refers to a saveall that concentrates usable fibers in a first fraction and concentrates the particulate matter in a separate fraction. Examples of Fractionating Savealls are described in U.S. Pat. Nos. 6,622,868 and 7,055,697. Thus, a Fractionating Saveall is distinguishable from a conventional saveall, such as a disc saveall, or from a dissolved air flotation clarifier in that the latter concentrate both the usable fibers and the fines together. What makes a Fractionating Saveall unique is that it separates fines from usable fiber, making it possible to recover the usable fiber without polluting the papermaking process with fines.

It is an object of the present invention to provide an effective method and system for reducing the loss of usable fibers from whitewater while simultaneously increasing paper making machine performance and paper quality. This is accomplished by utilizing the Fractionating Saveall to recover only the usable fiber left over following the sheet forming process. The usable fiber is recovered from and returned back into the whitewater system from the whitewater sump on the wet-end of the machine. The rest of the Fractionating Saveall stream is removed from the process loop. Water discharged this way only contains particulate matter (fines and ash). Purging it not only reduces the amount of undesirable material in the process but enables the operator to control total whitewater volumes simply by adjusting the rate of flow coming to the Fractionating Saveall. Volume control is key to managing the system and to avoid overflowing or otherwise spilling the enriched whitewater stream.

Recovering fiber with a Fractionating Saveall is effective whether the fiber goes into a stock stream or a whitewater stream. However, when the recovered fiber enters a thick stock stream, care must be taken to ensure that consistency in the chest is maintained. Otherwise, refining operations or end product basis weight control could be compromised. These problems are avoided when recovering fiber into a stock chest by using larger screening systems which are significantly more expensive (to purchase, install, operate, and maintain). Using the Fractionating Saveall at the wet-end sump can accomplish the same objectives (minimizing fiber loss and maximizing machine performance) at a fraction of those costs because the system is much smaller. When recovering into the whitewater system, consistency of the recovered fiber is of less importance. In fact, recovering fiber at lower consistencies is more desirable because these systems are designed to move water, not stock.

The Fractionating Saveall isolates and removes particulate matter from the whitewater system. As such, it serves to improve water drainage and machine efficiency. This means that the Fractionating Saveall can be used as a mechanical drainage aid.

Only a small portion of the total volume entering the Fractionating Saveall is recovered: the usable fiber. Most of the water (along with the fines) is isolated and can be removed from the process, giving the papermaker volume control. As a result, the usable fiber can be easily recirculated directly back into the whitewater stream without fear of overflowing the system elsewhere in the process.

In some embodiments of the methods and systems, the Fractionating Saveall is located in the whitewater system downstream of the wet-end sump pit, where the useful fraction is recovered into the whitewater chest directly. Others include recovery into the wire pit or silo, but the technique for using this device would be the same.

Fractionating Saveall technology which can be used in the present methods and systems include only that which is described in U.S. Pat. Nos. 6,622,868 and 7,055,697, the entire contents of which are incorporated herein by reference for the purpose of describing the components and functioning of that particular system. Water leaving the Fractionating Saveall will be very dilute with a low consistency. This fraction can be disposed of by, for example, routing it to the sewer or a wastewater treatment system. In contrast, the reusable fraction in which the useful paper making fibers are preferentially concentrated will have a thicker consistency. By way of illustration only, the reusable fraction may have a consistency in the range from about 0.5% to 0.75%, where consistency refers to the mass fraction (or percentage) of solid material in the fraction.

FIG. 1 illustrates an embodiment of a paper making method and system that uses a Fractionating Saveall as a mechanical drainage aid in combination with recirculation of recovered usable fibers directly back into the whitewater loop to reduce usable fiber loss and improve system performance. The paper making system shown in FIG. 1 is used for illustrative purposes. Not all of the components shown in this FIGURE are required, and other components that are conventionally used in paper making systems can be present even if they are not depicted in this FIGURE.

The paper making system illustrated in FIG. 1 includes a whitewater chest 1 that collects whitewater from the wet-end sump 6A of the paper making system. In the embodiment, whitewater from the whitewater chest 1 is fed into a hydrapulper 3 where it is mixed with dry pulp 2. In the hydrapulper 3, the pulp slurry undergoes hydrodynamic shear to loosen the pulp fibers as they are prepared into a high-consistency ("thick") pulp stock. From hydrapulper 3, the prepared stock is introduced into a sequence of chests where it is agitated and sequentially diluted. As shown here, the prepared stock first passes into the primary stock chest 4 for storage. It then is sent on to machine chest 5 from which it is metered at a constant rate into the supply stream ahead of fan pump 7. Water from the wire pit 6 combines with this stock, mixing as they are pulled into the fan pump. The fan pump pushes this slurry into and through the pressure screen 8, then into head box 9, and finally into the forming area 10. This is where the sheet 12 is formed. As water passes through the forming fabric 11, the fibers lay down a matrix on top of it. This is how paper is made. Although the illustrative system shown in FIG. 1 includes two chests, more could be used.

After the sheet is formed, it is transferred from the forming fabric 11 onto the machine felt 13 at the couch 14. As the felt and fabric pass between the couch rolls 14, the sheet is pressed onto the underside of the felt 13. The sheet is then carried by the felt into the dryer 15 and pressure roll 16 nip where it is pressed onto the dryer. The paper is then dried and wound up into a roll 18 at the reel 17.

Following sheet formation, the whitewater is collected back into the wire pit 6 from which it is resupplied with fiber from the machine chest 5 and the process continues. As the whitewater supply in the wire pit grows, the excess overflows into the wet-end sump 6A. Normally this sump would serve to recover the whitewater and deliver it back to the whitewater chest 1. However, in FIG. 1 the Fractionating Saveall 1A is installed so that a portion of this stream can be diverted to the device. The accepts 1B are recovered into the wet-end sump 6A. The waste fraction 2B goes to the sewer. When recovering usable fiber this way, some of it will invariably pass back into the Fractionating Saveall more than once, but the nature of the screening system traps that fiber until it is carried beyond this point and into the whitewater chest 1. A large portion of the flow discharged from the wet-end sump 6A is not expected to reach the Fractionating Saveall. Volumes and flow rates will vary depending on process and machine requirements. The key to operating this system effectively is to control the volume entering the device so as to balance the needs of stock prep with the amount of whitewater recovered to it. The removal of particulate matter (fines) from the paper making system serves as a mechanical drainage aid since the fine particles being removed could otherwise impede water drainage during wet-end sheet formation. The paper making system shown in FIG. 1 recirculates the usable fibers from the Fractionating Saveall back into whitewater rather than into the stock system. This is made possible because excess whitewater (the fines laden fraction) is sewered rather than recirculated back into the process. In this way, volume control can be managed.

As also illustrated in FIG. 1, the solutions described herein (e.g., pulp stocks and whitewater, wastewater, and/or usable fiber-containing discharge) can be passed from one container (e.g., chest, tank, chamber, pit, etc.) to another through one or more connecting conduits (e.g., pipes, tubing, etc.).

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A method for recovering usable pulp fibers in a paper making system, the method comprising: passing whitewater from a wet-end sump pit at the wet-end of the paper making system into a fractionating saveall, whereby the fractionating saveall separates the whitewater into a wastewater fraction in which particulate matter is concentrated and a useable fraction in which usable pulp fibers are concentrated; discharging the wastewater fraction from the paper making system; and circulating the useable fraction directly back into whitewater in a wire pit of the paper making system, directly back into whitewater in the wet-end sump pit of the paper making system, or directly into a whitewater chest of the paper making system.

2. The method of claim 1, wherein circulating the useable fraction directly back into whitewater comprises circulating the useable fraction directly back into whitewater in the wire pit.

3. The method of claim 1, wherein circulating the useable fraction directly back into whitewater comprises circulating the useable fraction directly back into whitewater in the wet-end sump pit.

4. The method of claim 1, wherein circulating the useable fraction directly back into whitewater comprises circulating the useable fraction directly into the whitewater chest.

* * * * *